US007287871B2

(12) United States Patent
Wiesberg et al.

(10) Patent No.: US 7,287,871 B2
(45) Date of Patent: Oct. 30, 2007

(54) LIGHT BOX DISPLAY WITH BRACKET ASSEMBLY AND SIGNAGE METHOD FOR BACK-TO-BACK VENDING DEVICES

(75) Inventors: Adam J. Wiesberg, Portland, OR (US); Steve E. Wiesberg, Portland, OR (US); Mark Wittmeyer, Portland, OR (US); Cindy Lamy, Portland, OR (US); Joseph J. Galati, Jr., Brookfield, WI (US); Anthony J. Galati, Milwaukee, WI (US)

(73) Assignee: Digital Sports Graphics, Inc., Las Vegas, NV (US)

( * ) Notice: Subject to any disclaimer, the term of this patent is extended or adjusted under 35 U.S.C. 154(b) by 282 days.

(21) Appl. No.: 11/049,854

(22) Filed: Feb. 3, 2005

(65) Prior Publication Data

US 2005/0168974 A1 Aug. 4, 2005

Related U.S. Application Data

(60) Provisional application No. 60/541,982, filed on Feb. 4, 2004.

(51) Int. Cl.
*F21S 13/10* (2006.01)

(52) U.S. Cl. ..... 362/125; 362/223; 362/224; 362/278; 362/812

(58) Field of Classification Search ..... 382/632–634, 382/139, 144, 169, 219, 223, 224, 277, 278, 382/365, 812; 40/549, 553, 564, 571, 574–577
See application file for complete search history.

(56) References Cited

U.S. PATENT DOCUMENTS

| | | | | |
|---|---|---|---|---|
| 399,017 A | | 3/1889 | Campbell | |
| 493,484 A | | 3/1893 | Corscaden | |
| 555,722 A | | 3/1896 | Corscaden | |
| 594,862 A | | 12/1897 | Doebler | |
| 1,189,988 A | | 7/1916 | Moody | |
| 1,501,555 A | | 7/1924 | Buzza | |
| 4,481,729 A | | 11/1984 | Weiller | |
| 4,923,157 A | | 5/1990 | Belamiza | |
| 5,373,428 A | | 12/1994 | Day | |
| 5,584,547 A | * | 12/1996 | Trulaske, Sr. | 312/223.5 |
| 5,618,100 A | | 4/1997 | Glynn | |
| 5,621,991 A | | 4/1997 | Gustafson | |
| 5,769,534 A | | 6/1998 | Lewis | |

(Continued)

FOREIGN PATENT DOCUMENTS

DE 3927722 A1 2/1991

(Continued)

OTHER PUBLICATIONS

Clearr Corporation, Display Division, Convex-Faced Backlit Displays brochure—2 pages, date unknown.

*Primary Examiner*—Sandra O'Shea
*Assistant Examiner*—Anabel Ton
(74) *Attorney, Agent, or Firm*—Lewis and Roca LLP

(57) ABSTRACT

A lightbox and bracket assembly for use preferably as a display at the end of a bank of devices, such as gaming devices is disclosed. The lightbox has an easily removable, magnetically secured cover. The lightbox includes features for reducing display installation time and removing hot spots cause by the light source from the display screen.

35 Claims, 5 Drawing Sheets

U.S. PATENT DOCUMENTS

| | | | | |
|---|---|---|---|---|
| 6,450,657 | B1 * | 9/2002 | Testa et al. | 362/604 |
| 6,484,429 | B1 | 11/2002 | Przylucki | |
| 6,578,301 | B1 | 6/2003 | Ericson | |
| 6,601,816 | B1 | 8/2003 | Hunte, II et al. | |

FOREIGN PATENT DOCUMENTS

| | | | |
|---|---|---|---|
| FR | 2402263 | 4/1979 | |
| GB | 2172734 A | 9/1986 | |
| GB | 0552967 A1 * | 7/1993 | 362/812 |
| NL | 6408482 | 1/1966 | |

* cited by examiner

LIGHT BOX DISPLAY WITH BRACKET ASSEMBLY AND SIGNAGE METHOD FOR BACK-TO-BACK VENDING DEVICES

RELATED APPLICATION

This application claims the benefit of co-pending Provisional Patent Application Ser. No. 60/541,982, filed 4 Feb. 2004.

BACKGROUND OF THE INVENTION

The present invention relates to lightboxes and more specifically to illuminated display structures and support structures for the illuminated display structures. Such devices may be used in kiosks in places such as shopping malls, movie theatres, and airports and may also be used as stand alone devices in places such as casinos.

Lightboxes have been used for some time as display cases. Generally, a poster or advertisement is placed within the lightbox, which illuminates and draws attention to the poster. Many previous designs for lightboxes have a square or rectangular lens shape and a flat lens surface. Such designs are not desirable for areas and situations where people may not be looking at the lightbox directly. For instance, lightboxes may be used as a bookend for a bank of slot machines within a casino, where a person may not approach the light box directly. In this type of application, a flat lens design would not be optimal.

To compensate for these shortcomings, light boxes with curved or arced display areas have been designed. However, while providing for a viewing surface from more angles, these boxes also have shortcomings. For instance, the lighting may not be evenly arranged and may cause hot spots within the light box. Likewise, these arrangements are difficult to remove or replace the advertisement or poster from the light box.

Besides the shape and arrangement of the boxes themselves, situating the boxes within a specified area, such as at the end of a bank of gaming devices, has also posed problems. Previous designs do not allow for easy movement or set-up of the boxes, which leads to longer and more arduous set-up time. For instance, time may be required to fasten the boxes to the gaming devices or the base that supports the gaming devices, which also requires time to insure that the light box is properly aligned.

For example, Ericsen, U.S. Pat. No. 6,578,301, describes a rectangular display box for displaying a poster above a bank of gaming devices having a flat lens. However, the structure and support in Ericsen is specifically designed for overhead display areas. These areas can be difficult to access if the device is to be moved and, also, difficult to access to change the display within the display box.

SUMMARY OF THE INVENTION

The present invention is a combination lightbox and bracket designed specifically for mounting a curved lens lightbox to a side of two back-to-back structures, such as two casino gaming machines or vending devices. Independent of any need to affix the bracket to a permanent base, the bracket slides beneath the structures and rests on the base, table, or surface that the structures also sit upon. Additionally, a welded cross member on the back of the bracket slides between the two back-to-back structures or gaming machines to support the weight of the lightbox once in place. The shape of the bracket bottom, the depth of the bracket, and the welded support arm allow the bracket to slide into place and support the weight of the lightbox without any need to permanently mount the bracket to the gaming machines or the base that supports the gaming machines. The bracket portion of the present invention consists of a designed stand or support engineered specifically to slide under the back-to-back structures.

The lightbox used in conjunction with the bracket is very unique in that it has a curved radius lens as opposed to the conventional flat lightbox lens. It also features a frameless design that eliminates a large external frame (which is commonly present on conventional lightboxes). The lightbox allows for very fast and easy changing of an image that is to be illuminated therein. The top-cap may be removed without the use of tools by using a combination of magnetic strips and plastic fasteners.

With the strategic placement of the lamps, the light box has also been designed so that the viewed image in the lightbox is substantially void of hot spots. The end result is a system that allows for substantial support of the plastic screens and associated image. The lightbox and bracket work as a system, thus affording the user an excellent opportunity to utilize space at the end of a bank of gaming machines or vending devices, while still providing an adequate display area that is not limited by the bank of structures.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure.

Figure 1:
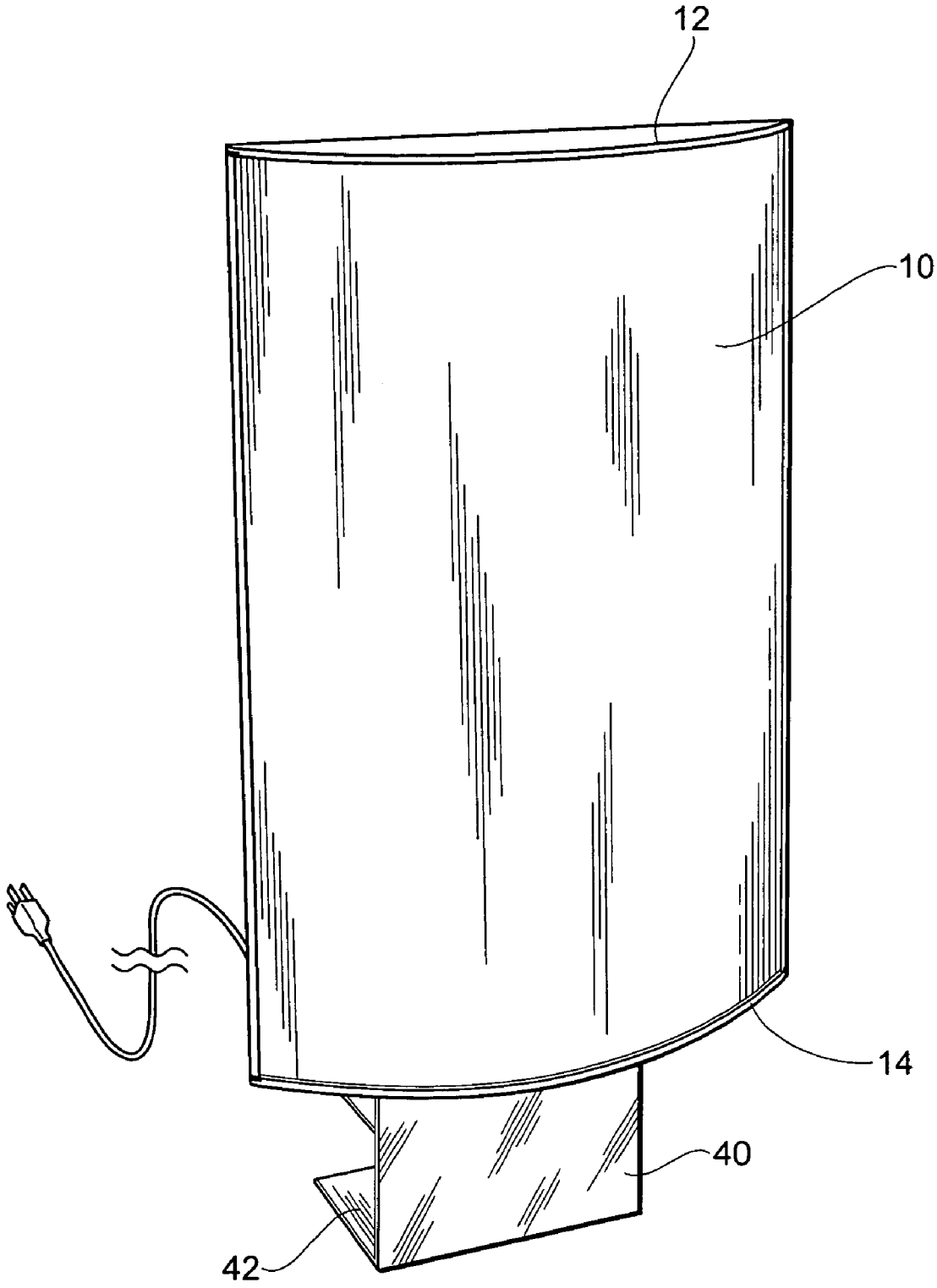
FIG. 1 is a front perspective view of a light box assembly according to the present invention.

FIG. 1 depicts a lightbox 10 and a bracket 40 according to the present invention. The lightbox 10 has a topside 12 and a bottom side 14. The lightbox 10 is preferably mounted on the bracket 40 so that the bottom side 14 of the lightbox 10 is elevated above a bottom 42 of the bracket 40.

Figure 2:
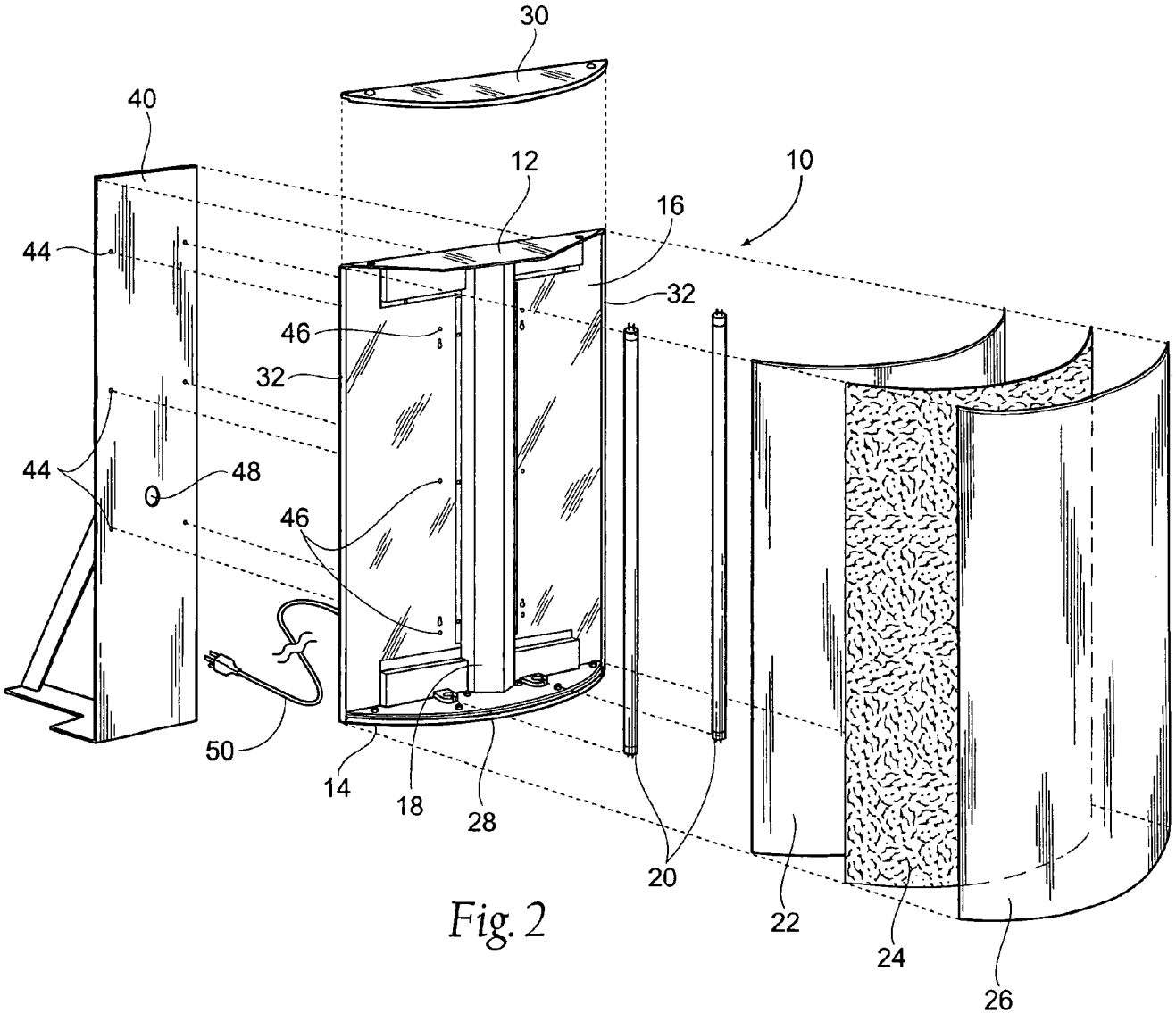
FIG. 2 is an exploded perspective view of the light box assembly of FIG. 1.

FIG. 2 shows an exploded view of the lightbox 10. The lightbox 10 has a main body or enclosure 16, which includes a ballast cover 18 extending from the topside 12 to the bottom side 14 of the lightbox 10. The ballast cover 18 provides support for the lightbox 10 and further provides a structure to house the ballast (not shown) that supply power to the florescent light bulbs 20. At the front of the main body 16 resides a first plastic sheet 22, an image 24 for display in the lightbox 10, and a second plastic sheet 26. The display image 24 is not a part of the present invention, but the present invention is designed so that the display image 24 is efficiently displayed and easily removed or replaced. The two plastic sheets 22 and 26 and the display image 24 are held in place by retaining means, shown as a slot 28 located on the bottom side 14 of the main body 16 and by a top cap or cover 30 located on the topside 12 of the main body 16. The slot 28 and the cover 30 will be discussed further with respect to the following Figures.

Still referring to FIG. 2, the main body 16 is supported on the bracket 40. A plurality of holes 44 formed in the bracket 40 correspond to a plurality of openings 46 located on the main body 16. The holes 44 and openings 46 allow for fastening devices, such as carriage nuts and bolts, screws or bolts (not shown), to secure the lightbox 10 to the bracket 40. The bracket 40 further comprises a passageway 48 that allows a power cord 50 from the lightbox 10 to be fed through the bracket 40. While the holes 44 and the openings 46 have been shown as potential areas to secure the lightbox 10 to the bracket 40, any means that will securely fasten the lightbox 10 and the bracket 40 together will fall within the scope of the invention. For instance, it may be possible for the lightbox 10 to slide into keyhole slots and be "hung" on the bracket 40. It may also be possible that the lightbox 10 and the bracket 40 are permanently secured to one another, which would also fall within the scope of the present invention.

Figure 3:
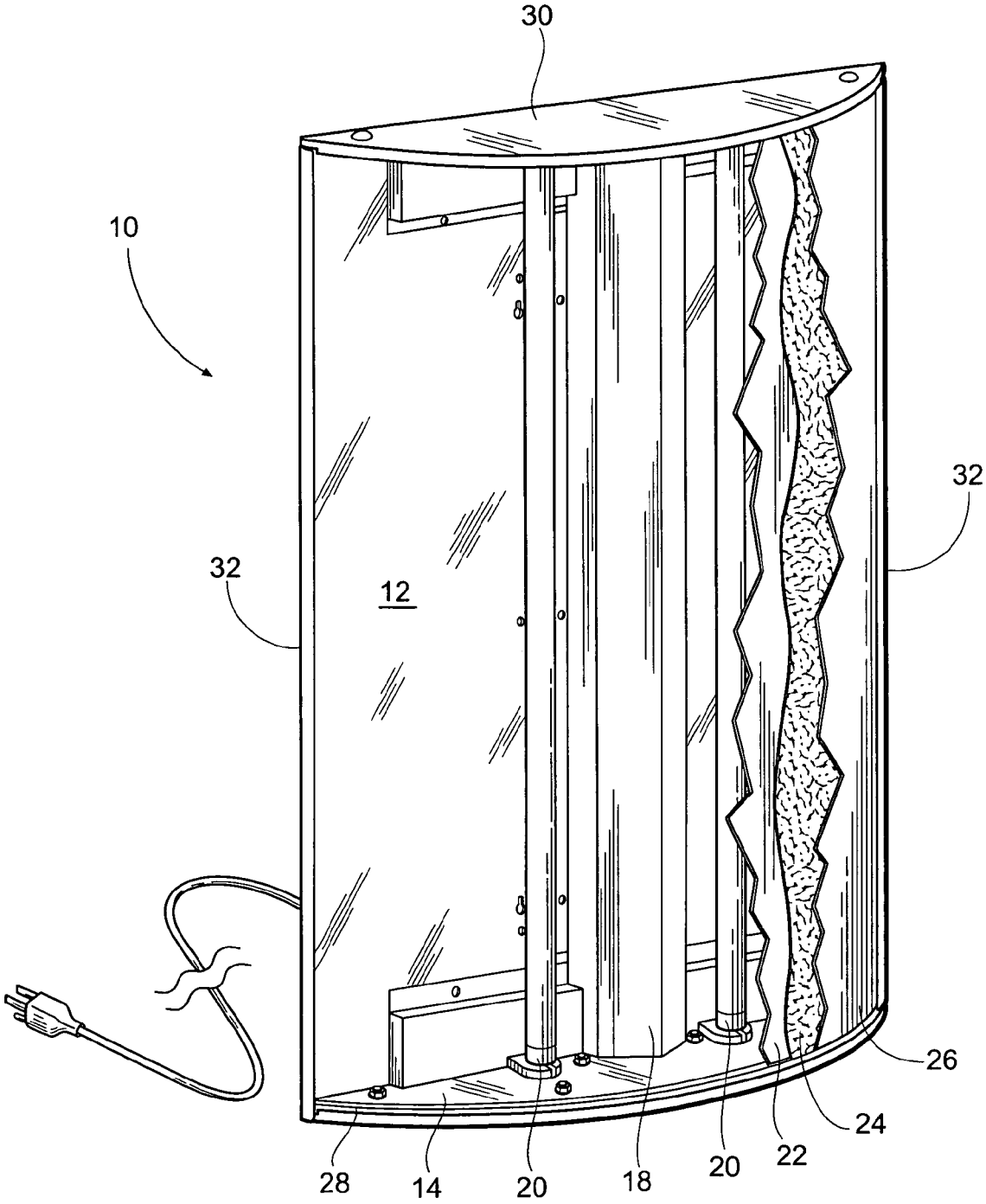
FIG. 3 is perspective partially cut-away front view of a light box according to the present invention.

A cut-away view of the lightbox 10 is shown in FIG. 3. As previously mentioned, the two plastic sheets 22 and 26 and the display image 24 sit within the slot 28. The lightbox 10 is arranged in such a fashion such that the sheets 22, 24, and 26 may be easily inserted and removed from the slot 28. A pair of edges 32 are located on opposite sides of the main frame 12. The sheets 22, 24, and 26 are slid or fed into the slot 28 by working around from one edge 32 to the other. The edges 32 work together with the cover 30 and the slot 28 to retain the sheets 22, 24, and 26 in place. The lightbox 10 may be designed without the side or lateral edges 32. However, the use of small edges 32 provides extra resistance for the sheets 22, 24, and 26 to be held in place. Furthermore, while larger edges 32 may be employed, the small edges provide resistance without interfering with the viewing area of the display image 24, thereby providing an essentially frameless display area. The edges 32 are also minimally invasive when installing or removing the sheets 22, 24, and 26.

FIG. 3 also shows the light bulbs 20 mounted within the main body 16. The arrangement of the bulbs 20 is unique over previous designed lightboxes. When designing the present invention, it was observed that previous designs contained hot spots. Hot spots, which are areas where the light source is close enough to the viewing surface or plastic sheets so that the outline of the light source may be seen through the plastic sheets or display image. Hot spots may unnecessarily heat areas of the plastic sheets 22 and 26 and/or the display image 24. Hot spots also lead to an uneven distribution of light over the viewing surface, which can compromise the quality of the image to be displayed in the display box. To overcome these problems, the present design has light bulbs 20 located closer to the ballast 18 than previous designs. For instance, in a rectangular light box having the dimensions 2'×3' the light bulbs 20 were moved approximately ½" inch inwards toward the ballast 18 than prior arrangements. In doing so, a potential existed for the center of the lightbox 10 to be illuminated more than the edges of the lightbox 10. To compensate for this, the front arc or curvature of the bottom side 14 (and the cover 30, as well) was moved outwardly from the ballast 18 in the same typical 2'×3' lightbox, also approximately ½ inch. Thus, by providing a properly dimensioned lightbox 10, where the light bulbs 20 are located inwardly of previous designs and the front arc of the bottom side is moved outwardly from previous designs, hot spots have been essentially removed from the lightbox 10. The present ratio of the light bulb location to the lightbox curve is unique and beneficial as compared to previous lightbox designs.

Figure 4:
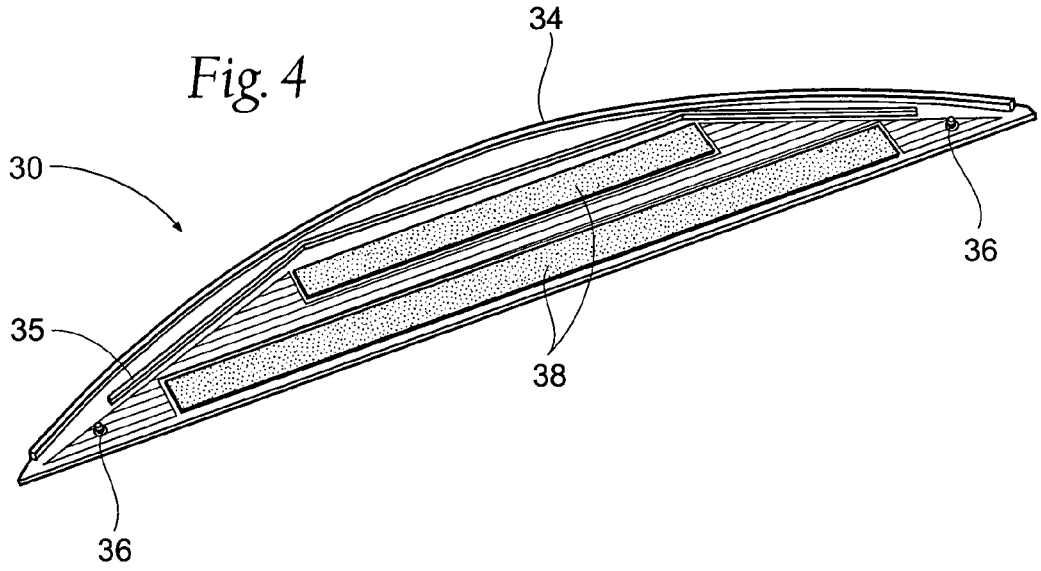
FIG. 4 is bottom plan view of a cover for a light box according to the present invention.

FIG. 4 shows a bottom view of the top cover 30. An outer ridge 34 and an inner ridge 35 work together to hold and situate the sheets 22, 24, and 26 in place, as shown in FIG. 3. The cover 30 may also have snaps 36 or other securing devices located on the cover 30. The snaps 36 provide alignment means for centering the cover 30 on the main body 16 (see FIG. 2) and also provide secondary securing means for the cover 30. The principal securing means are in the form of magnets 38. The magnets 38 interact with the main body 16, which is preferably made out of steel or some other magnetic material, to easily enclose and secure the sheets 22, 24, and 26 within the lightbox 10. The magnets 38 provide securing means that allows a quicker, more efficient placement of the cover on the lightbox 10. Since there are no hinges or pivots for attaching the cover 30 to the lightbox 10 as in previous designs, the cover 30 has less chance of being damaged and needing repairs. Likewise, easier placement of the cover 30 provides for easier removal and changing of the image display 24. Especially in an establishment, such as a casino or other gaming institution, which may use several hundred such lightbox displays that may be changed weekly or even daily, the efficient design of the present lightbox 10 and cover 30 can significantly reduce the time and money spent in changing and updating the image display 24. The magnets 38 further provide for the cover 30 to be lightweight and easily handled, while still providing adequate closure and housing for the lightbox 10.

Figure 5:
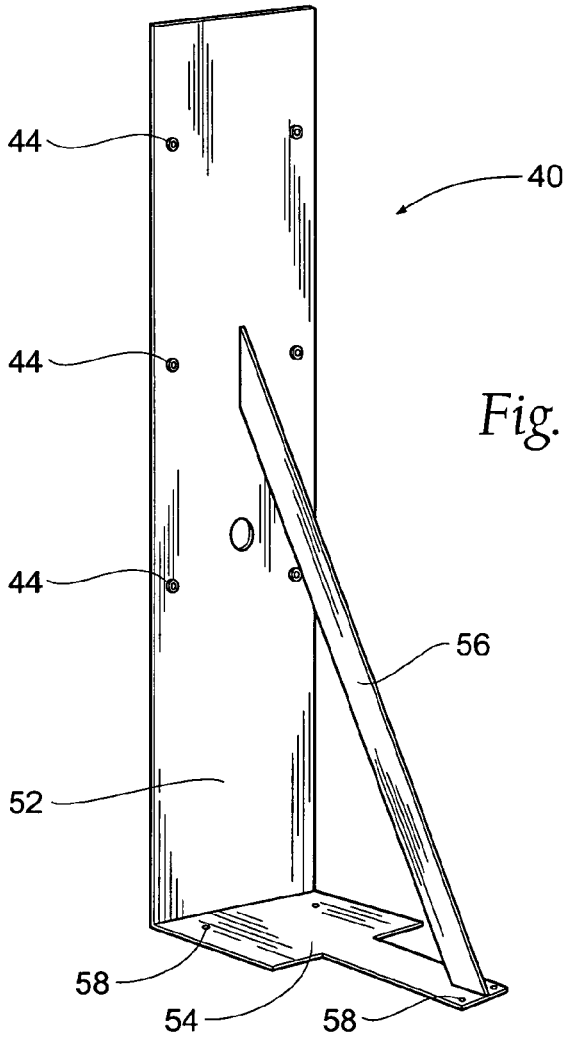
FIG. 5 is a perspective view of the bracket shown in FIGS. 1 and 2 and used for a light box assembly according to the present invention.

FIG. 5 shows a back view of the bracket 40 of the present invention. The bracket 40 is comprised of a generally upright section 52 and a base section 54 perpendicular to the upright section 52. A support brace 56 is preferably located along the center of the upright section 52 and the base section 54, connecting the two sections. The support brace 56 preferably lies in a plane that is both perpendicular to the upright section 52 and the base section 54. As previously noted, the upright section 52 has a plurality of holes 44 that allows the bracket 40 to be secured to the lightbox 10. Preferably, the bracket 40 is designed of a hard steel or metal material.

The base section 54 also has a plurality of holes 58 that will allow the bracket 40 to be secured to a cabinet or other surface. However, the bracket 40 is designed so the operator preferably will not have to manually secure the bracket 40 to a cabinet or surface. The base section 54 has a portion thereof that has a width that is greater than a horizontal space that separates the back-to-back gaming devices. The base section 54 slides underneath the devices for which the lightbox 10 is acting as an end bank, and the weight of the devices will hold the lightbox 10 and the bracket 40 securely in place. The bracket can be installed quickly without the use of tools. Likewise, the central support brace 56 insures that the lightbox 10 is centered between the gaming devices or other structures. The support brace 56 makes a sufficient angle so that the bracket 40 will adequately support the weight of the lightbox 10. The support brace 56 has a width or thickness that is less than the horizontal space between the back-to-back gaming devices.

Figure 6:
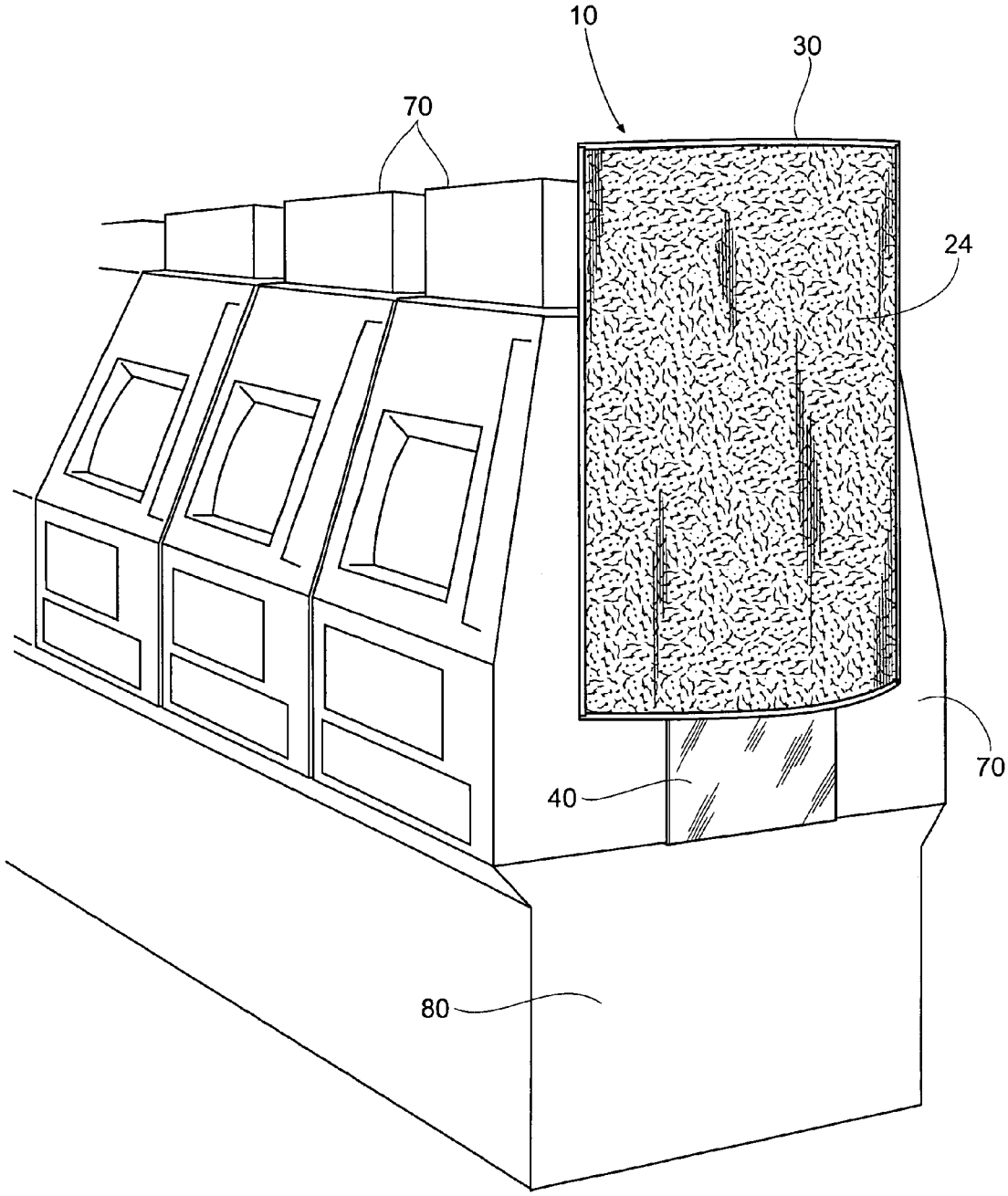
FIG. 6 is a perspective view of the light box of FIG. 1 in a typical environment.

FIG. 6 shows the lightbox 10 secured at the end of a row of gaming devices 70. The lightbox 10 preferably sits off of the ground, so that the display image 24 is at or near a person's eye-level. As previously noted above with respect to FIG. 5, the bracket 40 is held in place by the weight of the gaming devices 70, since, as noted above, the base section 54 is wider than the horizontal space between the backs of the gaming devices 70. Thus, the bracket 40 is preferably held in place without the need of fasteners to hold the bracket 40 and lightbox 10 in place. The arrangement simplifies the process of installing or removing the lightbox 10. If desired, a cabinet 80 may be placed below the lightbox 10. However, it is not necessary for the design or support of the invention to have a cabinet.

When the lightbox 10 is in a mounted position as shown in FIG. 6, removal of the display image 24 may be done quickly and easily. The cover 30 is removed, the display image 24 is removed, and a new display image 24 will replace the removed image. If it is easier for the person installing a new image, the second plastic sheet 26 and/or the first plastic sheet 22 may also be removed with little effort. Once replaced, the cover 30 is easily replaced on the lightbox 10. Also, the present invention simplifies maintenance procedures, such as changing a burned out light bulb. The plastic sheets 22 and 26 and the display image 24 are removed as stated above, which provides the user ample space to remove and change the light bulb.

As previously stated, the main body 16 is preferably designed of a metallic material. It is possible to provide only the topside 12 as a metallic material, but for production efficiency, the entire main body 16 would be formed from a single piece of metallic material. Similarly, the sheets of material 22 and 26 are described as plastic sheets, but could be formed of another material, provided that the material was sufficiently transparent to allow the light source to illuminate the display image 24.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A display box comprising:

an enclosure, said enclosure comprising a supporting, generally planar backing panel, said panel having a pair of laterally spaced, marginal edges, said backing panel including a predefined longitudinally extending axis lying between said marginal edges;

a light source having a portion thereof extending in parallel alignment with said axis;

a first curved, non-opaque cover sheet extending between said marginal edges;

a removable cover securing said first curved sheet on said display box; wherein said removable cover is secured to said display box with magnets;

retaining means located on said backing panel for releasably retaining said first non-opaque cover sheet; and a supporting bracket connected to said backing panel, said supporting bracket comprising;

an upright section;

a base section connected to said upright section, said base section generally perpendicular to said upright section;

a support brace lying in a plane generally perpendicular to said upright section and said base section, said support brace extending from said upright section to said base section.

2. The display light box according to claim 1 wherein said support brace is centrally aligned on said upright section and said base section.

3. The display light box according to claim 2 wherein said support brace is located centrally of said backing panel.

4. A combination of a side-mounted lightbox assembly with two back-to-back vending devices having a horizontal space between the vending devices, said lightbox assembly further comprising:

an enclosure, said enclosure comprising:

a backing panel having a pair of laterally spaced, marginal edges, a first curved, non-opaque cover sheet extending between marginal edges;

a light source located within said enclosure;

retaining means located on said backing panel for releasably retaining said first non-opaque cover sheet; and a supporting bracket connected to said backing panel, said supporting bracket comprising:

an upright section;

a base section connected to said upright section, said base section generally perpendicular to said upright section, said base section being slidable underneath said vending devices, said base section having at least a portion thereof having a width greater than said horizontal space;

a support brace extending from said upright section to said base section, said support brace having a thickness less than said horizontal space.

5. The assembly according to claim 4 wherein said support brace is situated in a plane generally perpendicular to said upright section and said base section.

6. The assembly according to claim 4 wherein said enclosure is removably connected to said supporting bracket.

7. The assembly according to claim 4 wherein said enclosure has a bottom side, said bottom side being elevated above said base section when said enclosure is connected to said supporting bracket.

8. The assembly according to claim 4 wherein said support brace is centrally located of said base section and said upright section.

9. A combination lightbox display and bracket assembly for viewing said lightbox display from the side of two back-to-back vending devices, said vending devices horizontally spaced apart, said assembly comprising:

an enclosure comprising:

a backing panel having a pair of laterally spaced, marginal edges;

a first curved, non-opaque cover sheet extending between marginal edges;

a light source located within said enclosure;

retaining means located on said backing panel for releasably retaining said first non-opaque cover sheet; and a supporting bracket connected to said backing panel, said supporting bracket comprising:

an upright section;

a base section connected to said upright section, said base section generally perpendicular to said upright section, said base section being slidable underneath said vending devices, said base section having at least a portion thereof having a width greater than said horizontal space;

a support brace extending from said upright section to said base section, said support brace having a thickness less than said horizontal space.

10. The assembly according to claim 9 wherein said support brace is situated in a plane generally perpendicular to said upright section and said base section.

11. The assembly according to claim 9 wherein said enclosure is removably connected to said supporting bracket.

12. The assembly according to claim 11 wherein said enclosure has a bottom side, said bottom side being elevated above said base section when said enclosure is connected to said supporting bracket.

13. The assembly according to claim 9 wherein said support brace is centrally located of said base section and said upright section.

14. For back-to-back vending devices having a side adjacent to the front of each said vending device that bears user controls, a display for projecting from the side of the back-to-back vending devices, the display comprising:

a substantially L-shaped support member having a surface for bearing at least part of the weight of the two back-to-back vending devices;

a translucent sign having an inside surface concave towards the side of the back-to-back vending devices and projecting from the substantially L-shaped support member; and means for substantially evenly illuminating the concave inside surface of the translucent sign.

15. The display as defined in claim 14, further comprising a support brace respectively attached at opposing ends of the substantially L-shaped support member.

16. The display as defined in claim 15, wherein the support brace has opposing surfaces each for contacting a respective said back of the back-to-back vending devices.

17. The display as defined in claim 14, wherein the translucent sign has opposing edges at least one of which contacts means for maintaining the translucent sign stationary relative to the substantially L-shaped support member.

18. The display as defined in claim 14, further comprising a body, attached to the substantially L-shaped support member, having opposing edges for slidably receiving opposing sides of the translucent sign.

19. For back-to-back vending devices having a side adjacent to the front of each said vending device that bears user controls, a display for projecting from the side of the back-to-back vending devices, the display comprising:

first and second support members each having first and second opposing end portions, wherein:

the first support member projects from the first end portion of the second support member; and the second end portion of the second support member has a load bearing surface for bearing at least part of the weight of two back-to-back vending devices;

a translucent sign concave towards the first support member and projecting from the second end portion of the first support member; and means for substantially evenly illuminating the translucent sign.

20. The display as defined in claim 19, wherein:

the translucent sign projects away the second display support;

the inside surface of the translucent sign is concave towards the side of the two back-to-back vending devices;

the first support member projects substantially perpendicular from the first end portion of the second support member;

the translucent sign has an inside surface facing the first support member; and the illuminating means substantially evenly illuminates the concave inside surface of the translucent sign.

21. The display as defined in claim 19, further comprising a support brace respectively attached at the second end portions of the first and second support members.

22. The display as defined in claim 21, wherein the support brace has opposing surfaces each for contacting a respective said back of the back-to-back vending devices.

23. The display as defined in claim 19, wherein:

the translucent sign has opposing edges respectively proximal the first and second end portions of the first support member; and at least one said opposing edge contacts means for maintaining the translucent sign stationary relative to the first support member.

24. The display as defined in claim 19, further comprising a removable cover situated upon the translucent sign in contact with an edge of thereof that is proximal the second end portion of the first support member.

25. The display as defined in claim 24, wherein the cover includes means for maintaining the translucent sign stationary relative to the first support member.

26. The display as defined in claim 19, further comprising a body, attached to the first support member, having opposing edges for slidably receiving opposing, sides of the translucent sign.

27. A signage method for a side of back-to-back vending devices, the side being adjacent to the front of each said vending device that bears user controls, the method comprising:

placing the back-to-back vending devices upon a load bearing surface of a second end portion of a second support member, wherein:

the second support member has a first end portion opposing the second end portion;

a first support member projects from the first end portion of the second support member; and the first support member has first and second opposing end portions;

placing a translucent sign that is concave towards the first support member so as to projecting from the second end portion of the first support member; and substantially evenly illuminating the concave surface of the translucent sign.

28. The signage method as defined in claim 27, further comprising:

removing the translucent sign by sliding opposing sides thereof within and out of respective edges of a body attached to the first support member; and replacing the translucent sign by sliding opposing edges thereof into the respective edges of the body attached to the first support member.

29. The signage method as defined in claim 28, wherein the sliding is substantially parallel to the side of the back-to-back vending devices.

30. The signage method as defined in claim 28, further comprising:

prior to said removing, taking off a cover situated upon the translucent sign in contact with an edge of thereof that is proximal the second end portion of the first support member; and after said replacing, putting the cover upon the translucent sign in contact with the edge of thereof that is proximal the second end portion of the first support member.

31. The signage method as defined in claim 30, wherein the cover includes means for maintaining the translucent sign stationary relative to the first support member.

32. The signage method as defined in claim 27, wherein:

the translucent sign projects away the second display support;

the concave surface of the translucent sign is toward the side of the two back-to-bad vending devices;

the first support member projects substantially perpendicular from the first end portion of the second support member; and the concave surface of the translucent sign faces the first support member.

33. The signage method as defined in claim 27, wherein a support brace is respectively attached at the second end portions of the first and second support member.

34. The signage method as defined in claim 33, wherein the support brace has opposing surfaces each for contacting a respective said back of the back-to-back vending devices.

35. The signage method as defined in claim 27, wherein:

the translucent sign has opposing edges respectively proximal the first and second end portions of the first support member; and at least one said opposing edge contacts means for maintaining the translucent sign stationary relative to the first support member.

* * * * *